United States Patent [19]

Cook

[11] 4,198,949

[45] Apr. 22, 1980

[54] SLINGSHOT WITH ADJUSTABLE SIGHT

[76] Inventor: Julian L. Cook, 106 Morningside Dr., Albany, Ga. 31705

[21] Appl. No.: 907,806

[22] Filed: May 19, 1978

[51] Int. Cl.[2] ..... F41B 3/00

[52] U.S. Cl. ..... 124/20 R; 33/263; 16/110 R

[58] Field of Search ..... 124/20 R, 24 R, 23, 124/87, 88; 33/265, 263; 16/110

[56] References Cited

U.S. PATENT DOCUMENTS

| | | | |
|---|---|---|---|
| 1,072,988 | 9/1913 | Pratt et al. | 124/20 R X |
| 1,207,025 | 12/1916 | Grigsby | 124/20 R |
| 2,574,599 | 11/1951 | Stieber | 124/87 X |
| 2,667,863 | 2/1954 | Styles | 124/20 R |
| 3,018,770 | 1/1962 | Saunders | 33/265 X |
| 3,618,585 | 11/1971 | Allison | 124/20 A |
| 3,901,209 | 8/1975 | Woolsey et al. | 124/20 R |
| 4,026,032 | 5/1977 | Smith | 33/265 |

*Primary Examiner*—William R. Browne
*Attorney, Agent, or Firm*—Bell Seltzer, Parks & Gibson

[57] ABSTRACT

A slingshot for hunting, target shooting, or the like, and which includes an adjustably mounted aiming device optimumly located between the slingshot prongs for accurate and selective alignment of the projectile trajectory's range and horizontal placement. The elastic band is releasably mounted to the ends of the slingshot prongs, so that the band protrudes in alignment therewith, thereby reducing the danger of the projectile striking the slingshot or the user's hand, while permitting the mounting of the aiming device between the prongs and making possible rapid and convenient interchange of elastic bands. A slingshot handle, having a cross-sectional dimension parallel to the projectile's trajectory greater than the perpendicular dimension, is also provided for improved safety, accuracy, and facility of use.

21 Claims, 17 Drawing Figures

SLINGSHOT WITH ADJUSTABLE SIGHT

The present invention relates to an improved slingshot which is characteristically used in hunting or target shooting, and more particularly concerns a slingshot which employs unique structural features that enhance the accuracy and facilitate the use thereof. Specifically, the invention is adapted to accurately and consistently align the projectile's trajectory with respect to range, horizontal deviations, and wind velocity through the use of an adjustable aiming device optimumly disposed between the slingshot prongs, while increasing the convenience of interchanging elastic bands on the slingshot, and affording protection to the user from imperfectly launched projectiles.

Although other instruments for launching or shooting projectiles, such as guns or bows, have been traditionally equipped with or altered to accommodate devices for aiming such, it has not been customary to employ aiming devices or sights with slingshots. However, the rising sports of hunting and target shooting with sling-shots have initiated a search for means and methods of improving the accuracy and consistency of the slingshot, and consequently, the use of an aiming device has become desirable. Prior slingshots that incorporate sights or aiming devices have been inadequate because the sights are stationary and unadjustable. Compensation for targets of varying ranges, horizontal trajectory deviations, and wind velocity is not possible since the user cannot move the sight properly view the target. The user is therefore required to approximate the effects of the various factors influencing the trajectory and estimate the variations in alignment necessary to compensate therefor. The result is unsatisfactory and usually the same as if no sight were employed.

In customary usage, a conventional slingshot is sighted by aligning the slingshot so that the target is viewed between the slingshot prongs. However, since the elastic bands are typically attached to the edges or backs of the slingshot prongs so as to protrude perpendicularly from the prongs and toward the user, the trajectory of the projectile will pass between the prongs, and consequently, it is generally not possible to locate the stationary sight or aiming device in that position. Other slingshots incorporating aiming devices have positioned the sight in a location above, below, or to the side of the center of the area between the prongs and the position normally traversed by the projectile trajectory. Consequently, error is introduced because of the displacement of the sight from the position of maximum accuracy and because of the requisite compensation required of the user to acquire accuracy and consistency. Slingshot sights, such as in U.S. Pat. to Fernsel No. 2,600,524, which have employed mechanisms or devices to remove the sight from the path of the projectile's flight, frequently cannot be relocated in their original positions for subsequent shots, and the placement and removal of the sight is often dependent on the indefinite operation of the elastic band.

Furthermore, the danger of an incorrectly launched projectile striking the slingshot prongs or the hand of the user is aggravated because of the insufficient distance between the trajectory and the potential obstructions. In addition as a consequence of the danger posed by the projectile, the user of the slingshot tends to drop or turn the hand holding the slingshot body at the time the elastic band is released and when the projectile is launched. This occurrence, which is known as "hunching" or "flipping" the hand, results in an erratic trajectory, negates any accuracy otherwise accrued from sighting, and eliminates the consistency of operation that is particularly desirable in target shooting.

The design of conventional slingshots has not been planned or adapted for the comfort or convenience of the user. Thus, frequently the handles of such slingshots have a cross section with a dimension perpendicular to the flight of the projectile greater than the parallel dimension. This construction requires the user to grasp the handle of the slingshot in such a manner as to expose a large portion of the back of his hand to an improperly launched projectile. Furthermore, the unnatural position of the hand in grasping such handles impedes consistency, accuracy, and the full use of the strength in the wrist. Tapered and knurled designs which diminish in cross section toward the slingshot prongs and provide grooves for the user's fingers, as disclosed in U.S. Design Pat. to Miller et al No. Des. 162,331, do not naturally fit across the palm of the hand or permit adaptable use by shooters with different size hands. Furthermore, the use of such tapered and knurled handles on slingshots having an elastic band protruding from the ends and parallel to the prongs would hinder the reversible use of the slingshot whereby the elastic band can be drawn to either side of the slingshot body.

The structure of conventional slingshots is also inadequate in that the elastic band is either permanently attached to the slingshot prongs or is difficult to remove and replace. In many instances the elasticity of the elastic band or separate wedging members are employed to secure the band to the prongs. These and other methods, however, do not adequately prevent the band from slipping from its mounting when the band is drawn. In addition, permanent or semipermanent attachment of the elastic band does not allow convenient and rapid interchange or replacement of elastic bands.

Accordingly, it is an object of the present invention to provide a slingshot having an aiming device that is adjustable for targets at varying distances, horizontal deviations of the trajectory, and corrections for wind velocity.

Another object of the invention is the provision of a slingshot that reduces the dangers to the user from incorrectly launched projectiles, while improving the accuracy and consistency of operation which is otherwise deficient because of the proximity of the projectile's trajectory to the user's hand and the slingshot body.

It is another object of the present invention to provide a slingshot that permits the location of an adjustable aiming device at its optimal position between the slingshot prongs by attaching the elastic band to the slingshot so that the band protrudes from the extremities of the slingshot prongs and in alignment therewith, whereby the trajectory of the projectile is displaced so as to traverse an elevation at the extremities of the prongs. In this connection and by this structural arrangement, it is also an object of this invention to provide a reversible slingshot that is operable when the elastic band is drawn to either side of the slingshot body.

It is a further object of the present invention to provide a slingshot having a handle that is comfortable and safe for the user to hold, that assists the user in aiming whereby accuracy can be improved, and that permits the user to apply a stronger grip so as to acquire greater projectile distances and higher projectile velocities.

Still another object of the invention is the provision of a slingshot which is so designed that the elastic band can be readily and conveniently detached and replaced, but which firmly secures the elastic band to the slingshot prongs so that the band will not slip from its mounting when in use.

These and other objects of the present invention are achieved in the embodiments illustrated herein by the provision of a slingshot which comprises a generally Y-shaped slingshot body that includes a handle defining a longitudinal direction and two forked prongs mounted on one end of the handle so as to extend outwardly therefrom. An elastic band is diposed at the remote ends of the prongs to carry and project a projectile, and means for mounting the elastic band secures the band to the ends of the prongs so that the band protrudes from each of the ends in a direction which is aligned with the direction of the prongs. Also provided is a sight for aiming the slingshot and means adjustably mounting the sight substantially between the prongs so as to permit both effective movement of the sight perpendicularly with respect to the longitudinal direction for lateral adjustment thereof and effective movement in the longitudinal direction for elevational adjustment thereof, whereby the sight may be adjusted to accommodate variations in both horizontal alignment and distance.

Some of the objects and advantages of the invention having been stated, others will appear as the description proceeds, when taken in connection with the accompanying drawings, in which FIG. 1 is a perspective view of a slingshot embodying the features of the present invention, and wherein the elastic band is drawn in preparation for the launch of the projectile;

Figure 1:
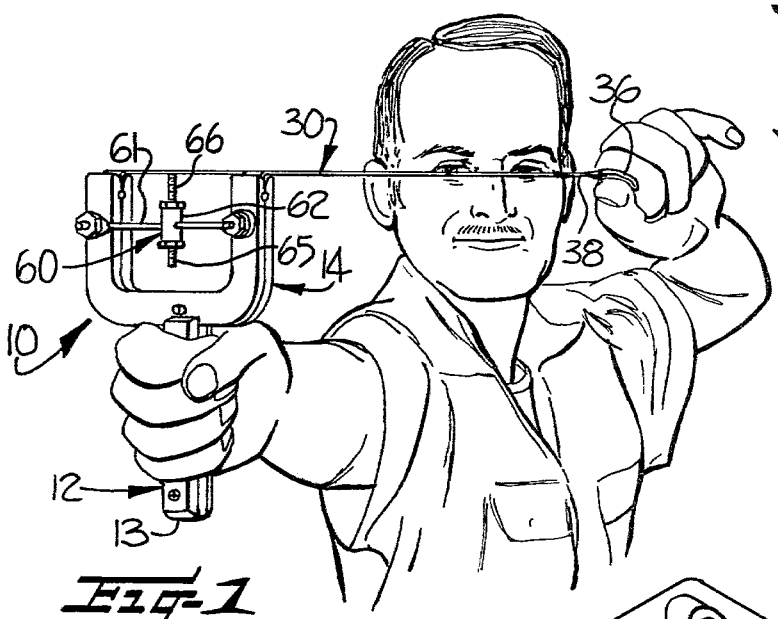
Figure 2:
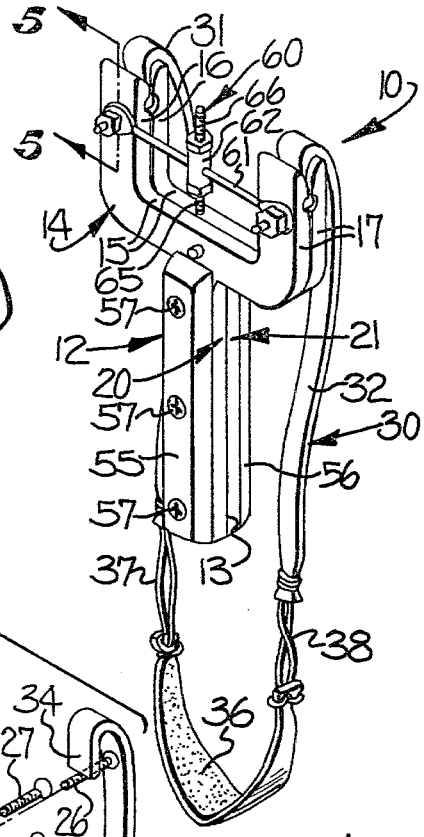
FIG. 2 is a perspective view illustrating the slingshot shown in FIG. 1.

Referring more specifically to the drawings, the embodiment of the slingshot illustrated in FIGS. 1–5 is indicated generally at 10, and will be seen to include a slingshot body 12 having a generally Y-shaped configuration. As shown, the slingshot body 12 includes an elongate handle 13 and a U-shaped prong portion 14 comprising a medial section 15, which is mounted to one end of the handle 13, and two prongs 16 and 17, which extend outwardly from the medial section 15 and in a direction substantially parallel to the longitudinal direction defined by the handle. In this embodiment, the handle 13 and the prong portion 14 are composed of two like half-sections 20 and 21. The half-sections 20 and 21, which can be manufactured or cast from any suitable material, such as aluminum or Bakelite, have opposing surfaces 22 and 23 that conformingly overlie each other to form a unitary slingshot body 12 as described above. Also, the handle 13 and prong portion 14 define a longitudinal plane, with the opposing surfaces 22 and 23 being positioned adjacent and substantially parallel to such plane. Threaded fasteners 25, 26 and 27, extending through the half-sections 20 and 21 secure the half-sections in a fixed relationship.

Elastic band means 30 for carrying and projecting a projectile is mounted adjacent the ends of the prongs 16 and 17, and in the illustrated embodiment includes two elastic members 31 and 32 having free ends 33 and 34 respectively, a projectile holder 36, and connecting means 37 and 38 for securing the projectile holder 36 to the elastic members. The elastic members 31 and 32 may be fabricated from any suitable elastic material, although strips of pure rubber and surgical tubing have been found to provide the best results. These materials have sufficient elasticity to impart instantaneous momentum to a projectile and are capable of withstanding repeated extension without deformation or breakage. The length of the elastic members 31 and 32 will vary according to the material used, but it is preferable to employ a length sufficient to allow extension of the elastic band means 30 in the manner illustrated in FIG. 1.

The projectile holder 36, which is fabricated from leather or any other suitable material, is formed in the shape of a sling so that a projectile can be placed within the sling, and the holder 36 grasped between the thumb and forefinger. In this manner, the projectile will be retained within the sling when the elastic members are extended for projection. Connecting means 37 and 38 secure the projectile holder 36 to the elastic members 31 and 32.

Figure 3:
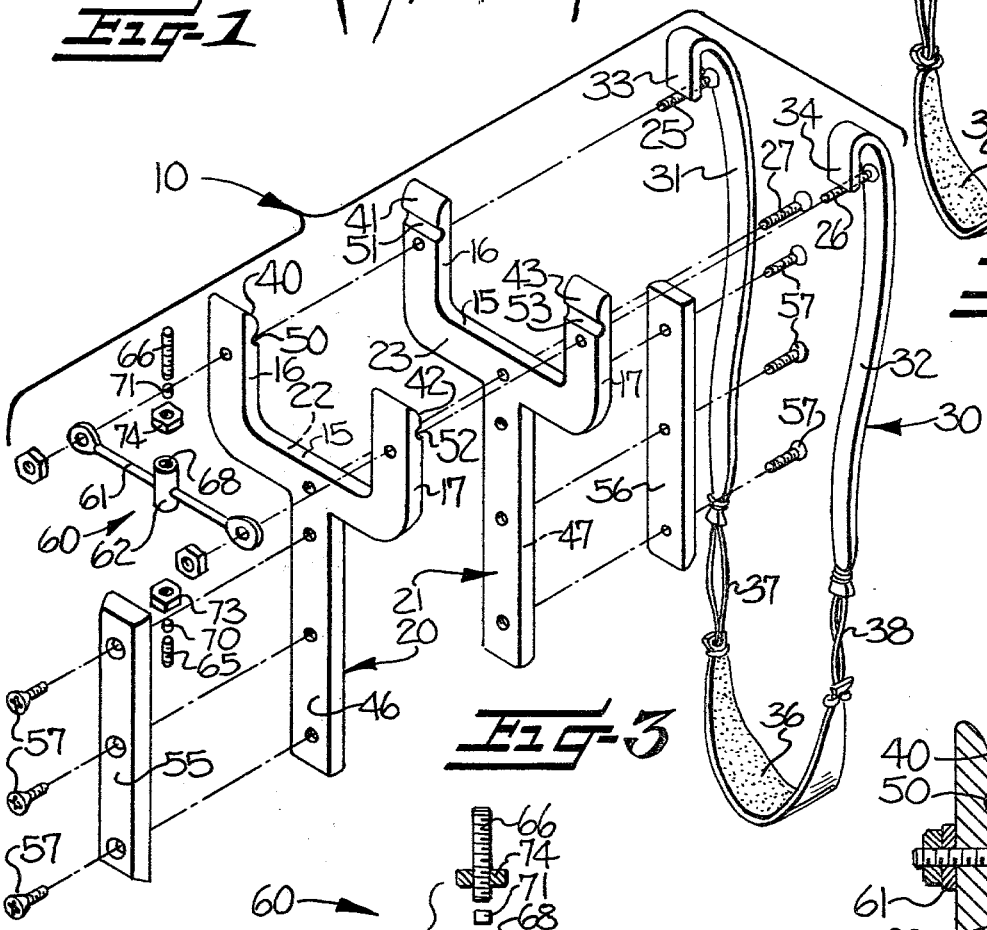
FIG. 3 is an exploded perspective view of the slingshot shown in FIGS. 1 and 2.
Figure 5:
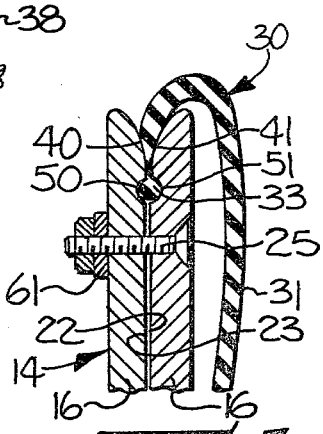
FIG. 5 is a sectional side view of a prong of the slingshot and taken substantially along the line 5—5 of FIG. 2.

Each of the prongs 16 and 17 also include opposing faces 40–41 and 42–43 respectively which are somewhat arcuate in cross section (note FIG. 5), but are otherwise adjacent and substantially parallel to the longitudinal plane defined by the handle 13 and prong portion 14. The faces 40–43 are part of the surfaces 22 and 23 and function so as to mount the elastic members 31 and 32. In this manner and as illustrated in FIGS. 3 and 5, the free ends 33 and 34 of the elastic members 31 and 32 are mounted between the associated opposing faces 40–41 and 42–43 respectively so that the free ends 33 and 34 protrude from the ends of the prongs 16 and 17 respectively in a direction that is substantially aligned with the direction of the prongs. The fasteners 25–27, which secure the half-sections 20 and 21, thereby clamp the free ends 33 and 34 between the associated opposing faces and retain the ends of the elastic members 31 and 32 in a fixed position with respect to the prongs. The elastic band means 30 can therefore be easily and conveniently removed and replaced by releasing the fasteners and withdrawing the ends 33 and 34 from between the opposing faces.

The manner of mounting the ends of the elastic members 31 and 32 as described above, wherein the ends project in a direction that is substantially aligned with the direction of the prongs, imparts a trajectory to the projectile which traverses an elevation at the ends or above the prongs. Thereby, the danger of the projectile striking a portion of the slingshot or the user's hand is minimized and accuracy and consistency is improved. As a further result of the mounting of the elastic band means 30, the slingshot can be used with either outside face 46 and 47 toward the user. This feature is particularly desirable when the slingshot is used for hunting since the elastic band means 30 can be quickly drawn without substantial manipulation or positioning in preparation for shooting.

The opposing faces 40–43 also include transverse grooves 50, 51, 52 and 53 respectively, which are each aligned with the groove of the associated opposing face, to thereby facilitate the clamping of the free ends 33 and 34 between the opposing faces. As shown in FIG. 5, the elasticity of the elastic members 31 and 32 provides secure and fixed mounting when the half-sections 20 and 21 are clamped, by remaining expanded within the vacant area formed by the grooves. In this manner the ends cannot easily slip from between the opposing faces. Vertical grooves (not shown) running from the ends of the prongs to the medial section 15 may also be included to accommodate tubular elastic members such as surgical tubing.

The handle 13 also includes plates 55 and 56 which are mounted with fasteners 57 to the outside faces 46 and 47 respectively in an overlying relation. Thereby, the cross-sectional dimension of the handle in the direction of the projectile's trajectory is greater than the cross-sectional dimension perpendicuar thereto, and the handle 13 can be grasped by the user so as to expose a minimum of the back of his hand to an incorrectly launched projectile. The plates 55 and 56 are fabricated from aluminum or Bakelite in the illustrated embodiment and give the handle 13 to a total thickness in its greater cross-sectional dimension that will comfortably fit in the user's hand when grasped.

Figure 4:
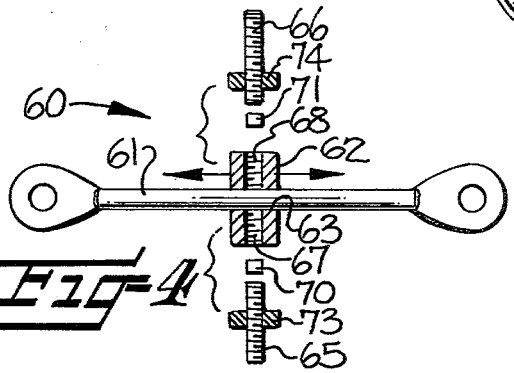
FIG. 4 is a sectional and exploded view of the sighting member of the slingshot.

A sighting member 60 is mounted between the prongs 16 and 17 on a bar 61 which extends between the prongs in a direction generally perpendicular to the longitudinal direction of the handle, and which is secured to the medial portions thereof by fasteners 25 and 26. As illustrated in FIGS. 3 and 4, the sighting member 60 includes an elongate body member 62 having a transverse bore 63 passing through its center for receiving the bar 61 therethrough. In this manner, the sighting member 60 can be slidaby moved along the length of the bar 61 and rotated on the bar in the manner and for the purpose explained below.

The sighting member also includes a first sight or projecting member 65 which is mounted to one end of the body member 62 and a second sight or projecting member 66 which is mounted to the other end of the body member, to extend in opposite directions and in a direction perpendicular to the direction of the bar 61. In the illustrated embodiment, the sights 65 and 66 are threaded and are received in threaded openings 67 and 68 which extend into the body member 62 at its opposite ends and in a direction perpendicular to the direction of the bar 61. Inserts 70 and 71 are also included so that the sighting member 60 can be frictionally secured to the bar 61 to eliminate free movement thereof, but so as to allow the user to change the sighting member's position by manually rotating or sliding the member. As illustrated in FIG. 4, the inserts 70 and 71, which are made of nylon or other suitable materials, are disposed between the sights 65 and 66 and the bar 61. The sights 65 and 66 are threaded into the openings 67 and 68 so as to apply pressure to the inserts 70 and 71 sufficient to hold the sighting member in place on the bar, but not to permanently fix it thereto. To secure the sights 65 and 66 in place with respect to the body member 62, nuts 73 and 74 are threaded on the sights and locked against the body member 62.

The first sight 65 has a relatively short projecting length which will depend upon the overall height of the slingshot, but which extends approximately $\frac{3}{8}$ inch from the bar in the illustrated embodiment. The height of the second sight 66 is also dependent upon the overall height of the slingshot, but is relatively long and extends approximately $\frac{1}{2}$ inch from the bar in the illustrated embodiment.

To aim the slingshot, the user employs the sighting member 60 by positioning the slingshot 10 so that a target will be visually aligned with the free end of a selected one of the sights 65 and 66. The initial selection for range can be made as follows: For short distances, the second sight 66 is rotated so as to project vertically, away from the user's hand, and in alignment with the handle 13, and the target is sighted above the end of the second sight 66. In the illustrated embodiment, targets in the range of up to 25 yards are sighted in this manner. A midrange target, between 25 yards and 50 yards in the illustrated embodiment, is sighted by rotating the sighting member 60 so that the first sight 65 is projecting vertically, away from the user's hand, and in alignment with the handle 13. The target is then sighted above the first sight 65. A second midrange target, between 50 and 75 yards, is sighted below the first sight 65 when it is oriented in a position projecting toward the user's hand. In a similar manner long range targets, beyond 75 yards, are sighted below the second sight 66.

After an experimental shot is launched and the proximity of the projectile's impact to the target is observed, the sighting member 60 can be adjusted to correct deviations in the trajectory. Thus, if the range was incorrect, a different sight can be selected for sighting or a different vertical orientation can be chosen. Alternatively, the sighting member 60 can be tilted so that the sights 65 and 66 do not project in alignment with the handle 13. Thereby, the visual length of projection is diminished and the free end of each of the sights 65 and 66 is effectively moved in the longitudinal direction of the handle for elevation or range adjustment. Horizontal deviations in the trajectory, due to misalignment or wind velocities may be corrected by laterally sliding the sighting member 60 on the bar 61 in the direction of the error.

Figure 6:
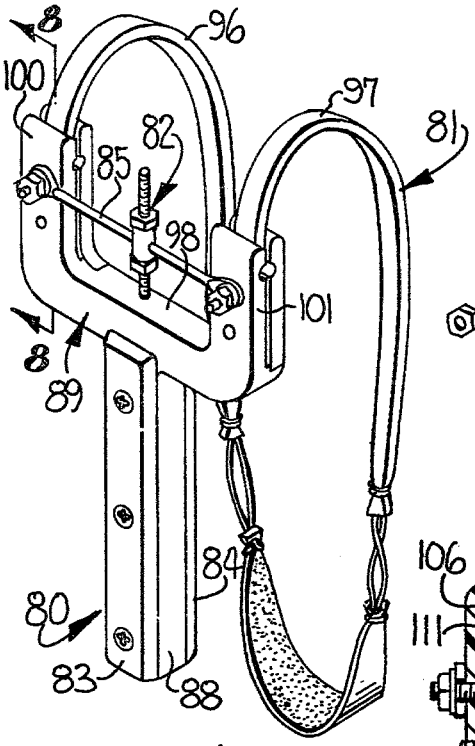
FIG. 6 is a perspective view of a second embodiment of the present invention.
Figure 7:
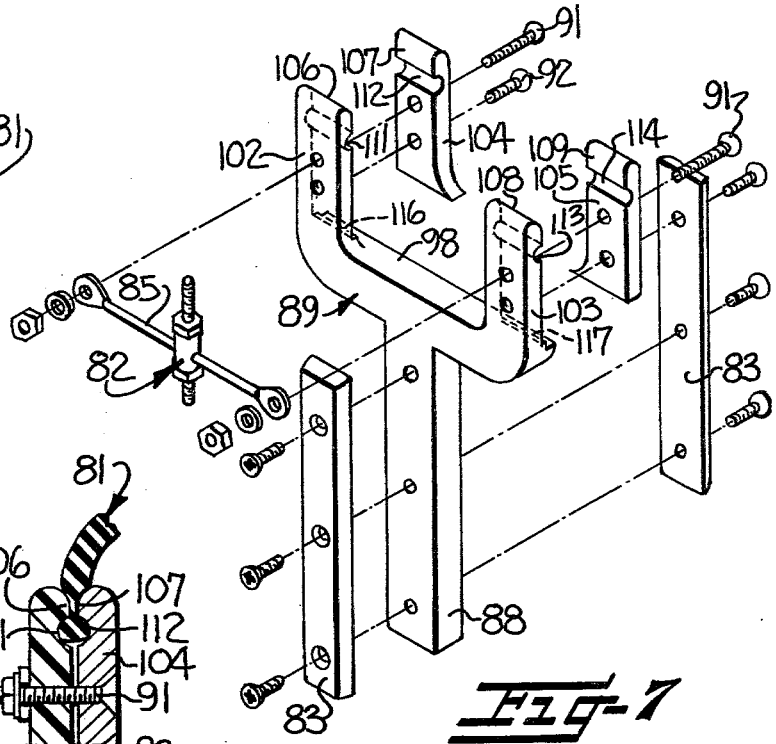
FIG. 7 is an exploded perspective view of the slingshot shown in FIG. 6.
Figure 8:
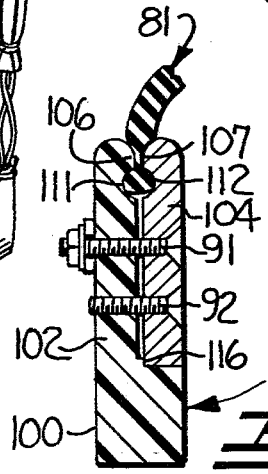
FIG. 8 is a sectional side view of a prong of the slingshot shown in FIG. 6, and taken substantially along the line 8—8.

A second embodiment of the invention is illustrated in FIGS. 6–8, and is indicated generally at 80. The elastic band means 81 and the sighting member 82 are generally constructed in the same manner as disclosed above for the slingshot illustrated in FIGS. 1-5. Also, plates 83 and 84 and bar 85 are as before and will not be further described.

The slingshot 80 of this embodiment includes a slingshot body comprising an elongate handle 88, a prong portion 89, and fasteners 91 and 92 to mount the elastic members 96 and 97. The prong portion 89, which is U-shaped, includes a medial section 98 mounted to one end of the handle 88 and two prongs 100 and 101 extending outwardly from the medial section and in a direction substantially parallel to the direction defined by the handle. Furthermore, each of the prongs 100 and 101 includes an integral portion 102 and 103 having a face 106 and 108 respectively adjacent and substantially parallel to a plane passing through the centers of the prongs and the center of the handle, and a mounting member 104 and 105 having a face 107 and 109 respectively adapted to conformingly overlie the face 106 and 108 of the associated integral portion 102 and 103.

In this embodiment, the handle 88, medial section 98, and integral portions 102 and 103 form a unitary structure. As was indicated concerning the first embodiment, the slingshot body may be fabricated from any suitable material, including aluminum and Bakelite.

The elastic members 96 and 97 are mounted between their respective integral portions 102 and 103 and mounting members 104 and 105 so as to protude from the ends of the prongs 100 and 101 in a direction substantially aligned with the direction of the associated prong 100 and 101 and as described above. As illustrated in FIG. 7, fasteners 91 and 92 secure the mounting members 104 and 105 to the associated integral portions 102 and 103 in an opposing face to face relationship, so that the elastic members 96 and 97 are secured between a cooperating pair of opposing faces 106–107 and 108–109. The elastic bands 96 and 97 can thereby be conveniently detached and replaced by releasing the fasteners 91 and 92 and removing the mounting members 104 and 105.

Transverse grooves 111–114 are also included on the faces 106–109 to facilitate the clamping of the elastic members 96 and 97 between the opposing faces. Furthermore, as seen in FIG. 8, a pivot 116 and 117 is included on each integral portion 102 and 103 as a molded part thereof, to permit the mounting members 104 and 105 to firmly grip the elastic members 96 and 97. When the fasteners secure each mounting member to the associated integral portion, the gap between the mounting member and the integral portion can be closed further at the location of the elastic member's attachment than at the pivot 116 and 117. Thereby the elastic member is pinched between the faces 106–107 and 108–109 in essentially one transverse location at the place of the attachment.

The embodiment in FIGS. 6–8 illustrates a further feature enabled by the manner of attachment of the elastic members 96 and 97. The overall length of the slingshot can be reduced and the size thereof made compact by reducing the length of the prongs 100 and 101. For slingshots intended for launching projectiles at short-range targets, the slingshot thereby becomes convenient for use. The size of the sighting member 82 will limit the possible reduction of prong length.

Figure 9:
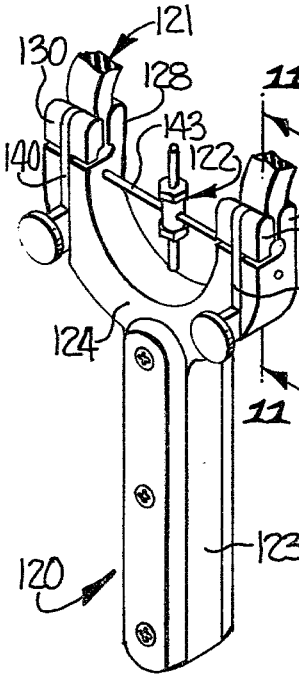
FIG. 9 is a perspective view of a third embodiment of the present invention.
Figure 10:
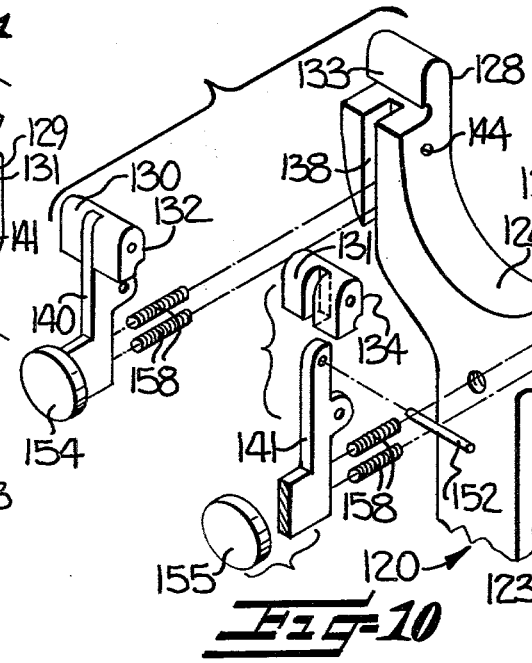
FIG. 10 is an exploded and partially sectional perspective view of the prong portion of the slingshot shown in FIG. 9.
Figure 11:
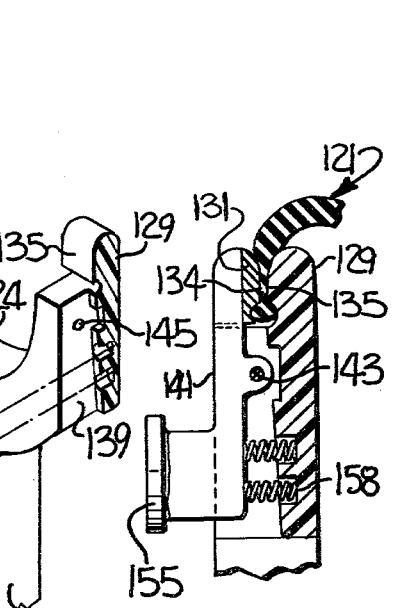
FIG. 11 is a sectional side view of a prong of the slingshot shown in FIG. 9, and taken substantially along the line 11—11.
Figure 12:
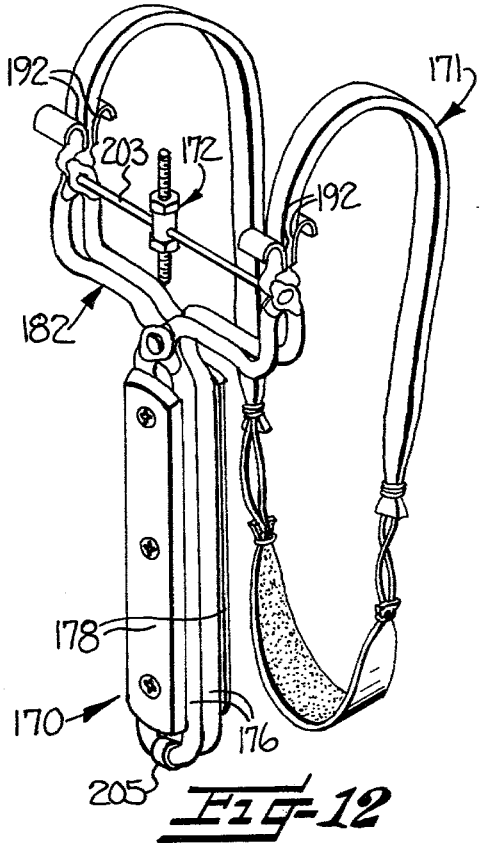
FIG. 12 is a perspective view of a fourth embodiment of the present invention.
Figure 13:
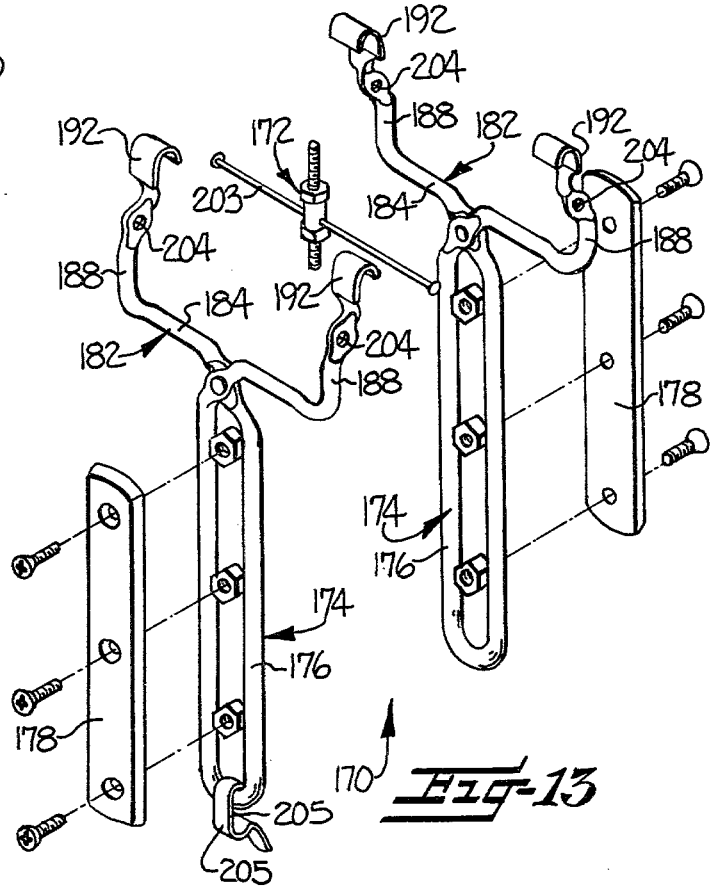
FIG. 13 is an exploded perspective view of the slingshot shown in FIG. 12.
Figure 14:
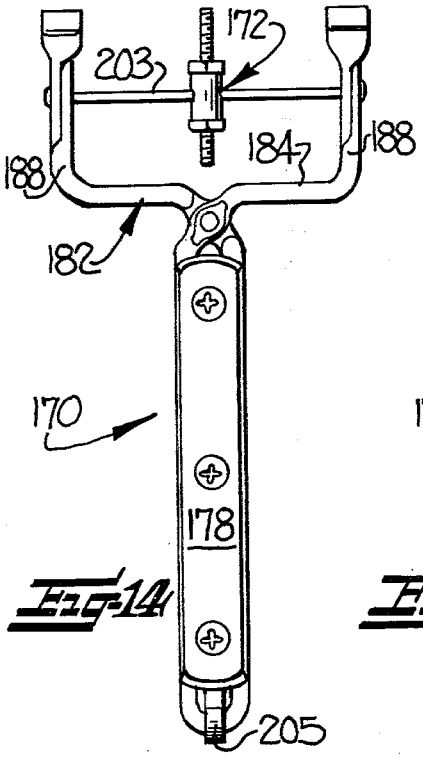
FIG. 14 is a front view of the slingshot shown in FIG. 12.
Figure 15:
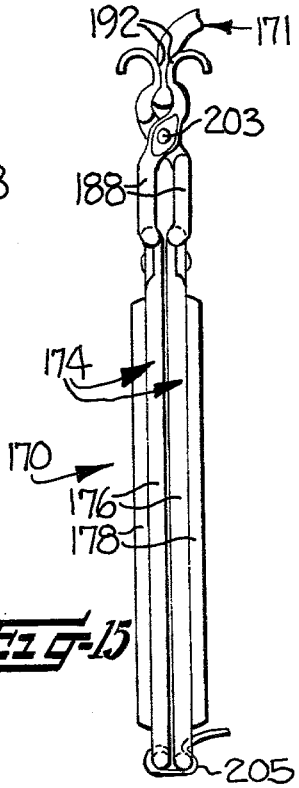
FIG. 15 is a side view of the slingshot shown in FIG. 12 and illustrating the slingshot in its closed or operative position.
Figure 16:
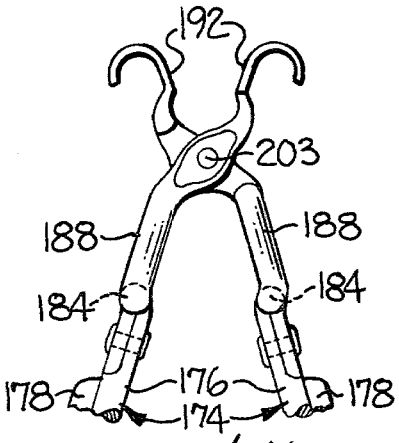
FIG. 16 is a side view of the prong portion of the slingshot shown in FIG. 12 and illustrating the slingshot in its disengaged or separated position.
Figure 17:
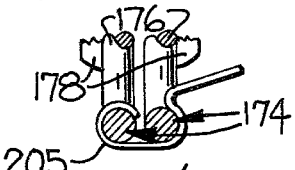
FIG. 17 is a sectional view of the latching mechanism of the slingshot shown in FIG. 12.

A further embodiment of the present invention is illustrated in FIGS. 9–11, and is designated generally at 120. This embodiment has substantially the same construction and configuration as discussed in the prior embodiments and includes an elastic band means 121, a sighting member 122, a handle 123, and a medial section 124 as discussed above. Each of the prongs comprises an integral portion 128 and 129 and a mounting member 130 and 131 having faces 132–135 in a manner as was discussed concerning the second embodiment.

Each of the prongs further includes a lengthwise slot 138 and 139 in the integral portion thereof for receiving a clamping lever 140 and 141. The bar 143, which mounts the sighting member 122, is disposed through apertures 144 and 145 in the inside edges of the prongs and through holes in the levers 140 and 141 to thereby function as a pivot for the levers. One end of each lever 140 and 141 is secured to its associated mounting member 130 and 131 by means of a pin 152. The opposite end of each lever 140 and 141 carries a button 154 and 155 to facilitate the manual pivoting thereof. Thereby, the levers 140 and 141 can be pivoted between a clamped position, as illustrated in FIG. 11, wherein the elastic band means 121 is secured between the opposing faces 132–133 and 134–135, and a disengaged position whereby the elastic member can be removed.

Compression springs 158 are mounted in the slots 138 and 139 and between each lever 140 and 141 and the integral portions 128 and 129 respectively so that the mounting members 130 and 131 are urged toward their clamped positions. The user can move the levers 140 and 141 to their disengaged positions by depressing the buttons 154 and 155 thereby compressing the springs 158 and moving the mounting members 130 and 131 away from the integral portions 128 and 129 respectively.

The fourth embodiment of the present invention, which is illustrated in FIGS. 12–17, is indicated generally at 170 and includes the elastic band means 171 and sighting member 172 as previously described in the prior embodiments. The slingshot 170 further includes two body frames 174 fabricated from a suitable material such as an integral length of tempered wire or molded plastic, and each comprising an elongate handle segment 176, having a plate 178, and a prong component 182 of generally a U-shaped configuration. Each prong component 182 includes a medial base 184 positioned at one end of the handle segment 176 and two prong members 188 which extend outwardly from the medial base 184 and in a direction substantially parallel to the direction defined by the handle segment 176. Each prong member 188 has a face 192 adjacent its extremity and positioned so that the faces of the prong members of each frame 174 are substantially co-planar and lie parallel to a plane defined by the handle segment and prong members of each frame.

The body frames 174 are pivotally connected at the medial portions of their respective prong members 188. Thereby, the body frames 174 overlie one another in a conforming relationship with the two handle segments 176 and plates 178 collectively defining the handle of the slingshot, and the two prong components 182 collectively defining the prong portion of the slingshot. Also, it will be seen that the faces 192 of the associated opposing prong members 188 oppose each other.

The pivotal connection between the body frames 174 is formed by the bar 203 which also mounts the sighting member 172. The bar 203 extends transversely through apertures 204 in the medial portions of the prong members 188 to thereby permit relative pivotal movement about an axis extending transversely between the prong members and as defined by the bar 203. In this manner, the opposing faces 192 of the prong members 188 can be pivoted toward and away from each other and the free ends of the elastic band means 171 can be clamped between the associated opposing faces so as to protrude from the prongs in a direction substantially aligned with the direction of the prongs as described above.

A clasp 205 is also included to retain the body frames 174 in their closed or operative position. When the elastic band means 171 is to be removed, the clasp 205 is released and the body frames 174 are separated, to thereby separate the opposing faces 192.

In the drawings and specification, there have been set forth preferred embodiments of the invention and although specific terms are employed, they are used in a generic and descriptive sense only and not for purposes of limitation.

That which is claimed is:

1. A slingshot characterized by improved accuracy arising from the ability to sight the target under varying wind conditions and at varying distances, and comprising a generally Y-shaped slingshot body including a handle defining a longitudinal direction, and two forked prongs mounted on one end of said handle and extending outwardly therefrom, elastic band means mounted to each of said prongs adjacent the remote ends thereof for carrying and projecting a projectile, a sight for aiming the slingshot, and means spanning the distance between said prongs for adjustably mounting said sight substantially between and independent of said prongs so as to permit both movement of said sight perpendicularly with respect to the longitudinal direction for lateral adjustment thereof and to support said sight for movement in the longitudinal direction for elevational adjustment thereof, whereby said sight may be adjusted to accommodate variations in both horizontal alignment and distance.

2. A slingshot as defined in claim 1 wherein said means adjustably mounting said sight comprises a bar mounted to extend between said prongs, and means slidably and rotatably mounting said sight on said bar.

3. A slingshot as defined in claim 2 wherein said means slidably and rotatably mounting said sight on said bar comprises a body member having a bore slidably and rotatably receiving said bar therethrough, and means mounting said sight on said body member.

4. A slingshot as defined in claim 3 wherein said means mounting said sight on said body member comprises an opening extending into said body member in a direction perpendicular to the axial direction of said bore, and with said sight being received in said opening.

5. A slingshot as defined in claim 4 further comprising a second sight for aiming the slingshot, and means mounting said second sight on said body member, and such that said two sights may be selectively employed in sighting the slingshot.

6. A slingshot as defined in claim 5 wherein said second sight is positioned on the opposite side of said bar from said first named sight, and extends radially from said bar a distance different from that of said first named sight.

7. A slingshot adapted for improved accuracy and facility of use and characterized by an elevated trajectory which minimizes the opportunity for the projectile to strike a portion of the slingshot or the user's hand, and comprising a generally Y-shaped slingshot body including an elongate handle defining a longitudinal direction, and two forked prongs mounted on one end of said handle and extending outwardly therefrom, elastic band means for carrying and projecting a projectile, means mounting said elastic band means to the remote ends of said prongs and so that said elastic band means protrudes from each of said ends in a direction which is substantially aligned with the direction of such end, a sight for aiming the slingshot, and means spanning the distance between said prongs for adjustably mounting said sight substantially between and independent of said prongs so as to permit both movement of said sight perpendicularly with respect to the longitudinal direction for lateral adjustment thereof and for supporting said sight for movement in the longitudinal direction for elevational adjustment thereof, whereby said sight may be adjusted to accommodate variations in both horizontal alignment and distance.

8. A slingshot as defined in claim 7 wherein the remote ends of said prongs extend in a direction parallel to the longitudinal direction defined by the handle.

9. A slingshot as defined in claim 8 wherein said means adjustably mounting said sight comprises a bar mounted to extend between said prongs, a body member having a bore slidably and rotatably receiving said bar therethrough, and means mounting said sight on said body member.

10. A slingshot as defined in claim 9 further comprising a second sight for aiming the slingshot, and means mounting said second sight on said body member so as to be positioned on the opposite side of said bar from said first named sight.

11. A slingshot as defined in claim 7 wherein said handle has a cross-sectional dimension in the direction of the projectile's trajectory greater than the cross-sectional dimension perpendicular thereto, to facilitate accuracy, safety, and comfort of use.

12. A slingshot adapted for improved accuracy and facility of use, and characterized by an elevated trajectory which minimizes the opportunity for the projectile to strike a portion of the slingshot or the user's hand, and comprising elastic band means for carrying and projecting a projectile, and having two ends;

a slingshot body comprising (a) an elongate handle defining a longitudinal direction, (b) a U-shaped prong portion including a medial section mounted to one end of said handle and two prongs extending outwardly from said medial section and in a direction substantially parallel to said longitudinal direction, with said two prongs defining a plane and with each of said prongs having two opposing faces adjacent and substantially parallel to said plane, and (c) means releasably mounting each end of said elastic band means between the associated opposing faces, so that said ends of said elastic band means are clamped between said opposing faces and protrude from the ends of said prongs in a direction which is substantially aligned with the direction of said prongs;

a sighting member for aiming the slingshot and including a plurality of separate sights; and means spanning the distance between said prongs for adjustably mounting said sighting member substantially between and independent of said prongs so that said sighting member is laterally adjustable to permit correction of horizontal alignment and said sights being spaced apart along said longitudinal direction to permit selective sighting of targets at varying distances.

13. A slingshot as defined in claim 12 wherein said opposing faces of said prongs each include a transverse groove, with the grooves of the opposing faces being aligned so that the clamping of said ends of said elastic band means between said opposing faces is facilitated.

14. A slingshot as defined in claim 12 wherein said handle and prong portion of said slingshot body both lie in said plane defined by said prongs, and wherein said handle and prong portion are composed of two half-sections, with said two half-sections having opposing surfaces adjacent and substantially parallel to said plane and including said opposing faces of said prongs, and with said mounting means also acting to interconnect said half-sections.

15. A slingshot adapted for improved accuracy and facility of use, and characterized by an elevated trajectory which minimizes the opportunity for the projectile to strike a portion of the slingshot or the user's hand, and comprising elastic band means for carrying and projecting a projectile, and having two ends;

a slingshot body comprising, (a) an elongate handle defining a longitudinal direction, (b) a U-shaped prong portion including a medial section mounted to one end of said handle, and two prongs extending outwardly from said medial section and in a direction substantially parallel to said longitudinal direction defined by said elongate handle, with said two prongs defining a plane and with each of said prongs including an integral portion having a face adjacent and substantially parallel to said plane, and a separate mounting member having a face adapted to conformingly overlie the face of an associated integral portion, and (c) means releasably mounting each of said mounting members in opposing face to face relationship with an associated integral portion of one of said prongs, and such that each end of said elastic band means may be secured between a cooperating pair of opposing faces and protrude from the end of the associated prong in a direction which is substantially aligned with the direction of said associated prong;

a sighting member for aiming the slingshot and including a plurality of separate sights, and means spanning the distance between said prongs for adjustably mounting said sighting member substantially between and independent of said prongs so that said sighting member is laterally adjustable to permit correction of horizontal alignment and said sights being spaced apart along said longitudinal direction to permit selective sighting of targets at varying distances.

16. A slingshot as defined in claim 15 wherein said means releasably mounting each of said mounting members comprises at least one threaded member extending through the mounting member and associated integral portion.

17. A slingshot as defined in claim 15 wherein said means releasably mounting each of said mounting members comprises a clamping lever pivotally connected to said integral portion of said prong, with the associated mounting member being mounted at one end of said clamping lever and such that the mounting member is pivotal between a clamped position and a disengaged position, and biasing means mounted between said clamping lever and integral portion for urging the mounting member toward its clamped position.

18. A slingshot as defined in claim 17 wherein said means releasably mounting each of said mounting members further comprises a button mounted on each of said clamping levers to facilitate the manual pivoting thereof toward said disengaged position.

19. A slingshot adapted for improved accuracy and facility of use, and characterized by an elevated trajectory which minimizes the opportunity for the projectile to strike a portion of the slingshot or the user's hand, and comprising elastic band means for carrying and projecting a projectile, and having two ends;

two body frames each comprising an elongate handle segment and a U-shaped prong component, said prong component including a medial base positioned at one end of said handle segment and two prong members extending outwardly from said medial base and in a direction substantially parallel to the direction defined by said elongate handle segment, with each of said prong members having a face adjacent its extremity, with the faces of the two prong members being substantially co-planar and lying parallel to a plane defined by the handle segment and prong members;

means for pivotally connecting said body frames in a conforming, overlying relationship and with the faces of the overlying prong members opposing each other, thereby defining a slingshot body comprising an elongate handle composed of said handle segments and a U-shaped prong portion composed of said prong components and having a medial section and two prongs extending outwardly therefrom, and so as to permit relative pivotal movement about a transverse axis, whereby said prong members can be pivoted between a closed position wherein each end of said elastic band means can be clamped between the associated opposing faces so as to protrude from the ends of said prongs in a direction which is substantially aligned with the direction of said prongs, and an open position wherein said opposing faces are separated;

a sighting member for aiming the slingshot, and means for mounting said sighting member substantially between said prongs.

20. A slingshot as defined in claim 19 wherein said means for pivotally connecting said body frames and said means for mounting said sighting member include a bar extending through and between said prong members of each body frame and defining said pivotal transverse axis, and with said sighting member being slideably and rotatably mounted on said bar.

21. A slingshot as defined in claim 20 further comprising means for releasably interconnecting said body frames so as to hold said prong members in said closed position.

* * * * *